United States Patent [19]

Heintzmann et al.

[11] Patent Number: 4,620,748

[45] Date of Patent: Nov. 4, 1986

[54] METHOD OF AND ARRANGEMENT FOR LOOSENING, LOADING AND TRANSPORTING OF STRATIFIED MINERALS IN UNDERGROUND ELONGATED FRONT LONGWALLS

[75] Inventors: Peter Heintzmann, Bochum; Manfred Koppers, Duisburg; Karlheinz Bohnes, Bochum; Heinz Kunzer, Herne, all of Fed. Rep. of Germany

[73] Assignee: Bochumer Eisenhütte Heintzmann GmbH & Co. KG, Bochum, Fed. Rep. of Germany

[21] Appl. No.: 597,525

[22] Filed: Apr. 6, 1984

[30] Foreign Application Priority Data

May 20, 1983 [DE] Fed. Rep. of Germany ..... 3318360

[51] Int. Cl.[4] ..... E21C 9/10

[52] U.S. Cl. ..... 299/18; 198/735; 299/44; 299/65

[58] Field of Search ..... 299/18, 44, 45, 65, 299/67; 198/509, 520, 735

[56] References Cited

U.S. PATENT DOCUMENTS

| | | | |
|---|---|---|---|
| 1,821,438 | 9/1931 | Levin | 198/735 |
| 4,364,470 | 12/1982 | Temme | 198/735 |
| 4,369,877 | 1/1983 | Hauer et al. | 198/509 |
| 4,437,562 | 3/1984 | Koppers et al. | 198/735 |

FOREIGN PATENT DOCUMENTS

| | | |
|---|---|---|
| 870836 | 7/1949 | Fed. Rep. of Germany . |
| 1172248 | 10/1958 | France . |

*Primary Examiner*—James A. Leppink
*Assistant Examiner*—William P. Neuder
*Attorney, Agent, or Firm*—Michael J. Striker

[57] ABSTRACT

A method of and an arrangement for loosening, loading and transporting of stratified minerals includes a single continuously rotating and forceably guided pulling organ, a plurality of loosening elements integrated in the pulling organ in its working run extending in a longitudinal direction of a longwall, and a plurality of transporting elements also integrated in the same single pulling organ at its transporting run located behind the working run at a back filling side, wherein the loosening elements perform loosening and loading functions, whereas the transporting elements perform the transporting functions in an opposite longitudinal direction of the longwall.

17 Claims, 8 Drawing Figures

METHOD OF AND ARRANGEMENT FOR LOOSENING, LOADING AND TRANSPORTING OF STRATIFIED MINERALS IN UNDERGROUND ELONGATED FRONT LONGWALLS

BACKGROUND OF THE INVENTION

The present invention relates to a method of and an arrangement for loosening, loading and transporting of stratified minerals, for example coal, particularly in underground elongated front longwalls.

For mining of stratified minerals in elongated front longwalls, cutting working means are provided, for example cutting machines, as well as stripping working means, such as planes. Transportation of the minerals is performed by a continuous rotating chain scraper conveyor. Thus, there appear separate operational groups which perform their special functions independently from one another.

It has been attempted to unite the winning and transporting steps with one another. French Pat. No. 1,172,248 discloses a solution in accordance with which a chain strand rotates in a vertical plane, and a loosening tool formed as a carrier is mounted on the chain strand. The loosening tool remains in engagement with the working face both in the working run and the return run. With the aid of the coupling with the loosening tools, the carrier is moved in the floor-side working run in a loosening direction. The return of the carrier is performed by a head.

A further proposal is disclosed in the German Pat. No. 870,836. Here a rotatable cutting chain moves in a vertical plane opposite to the carrier chain. Thereby a certain connection of the winning with the transportation in the sense of an economical use in the event of small stratum thicknesses takes place.

SUMMARY OF THE INVENTION

Accordingly it is an object of the present invention to provide a method of and an arrangement for loosening, loading and transporting of stratified minerals particularly in underground elongated front longwalls, in accordance with which winning, loading and transporting devices are integrated in one working means so that cooperation of devices providing different functions is simplified and thereby the efficiency of the longwall mining can be improved.

In keeping with these objects and with others which will become apparent hereinafter, one feature of the present invention resides, briefly stated, in a method of and an arrangement for loosening, loading and transporting of stratified minerals particularly in underground elongated front longwalls, in accordance with which loosening elements and transporting elements are integrated in a single endless rotatable and forceably guided pulling means so that in a working run of the pulling means the minerals are only loosened and loaded, whereas in an oppositely guided transporting run the minerals are finally transported.

When the method is performed and the arrangement is designed in accordance with the present invention, both the loosening elements and the transporting elements are components of a single pulling means. During operation of the inventive arrangement the loosening elements in the working run perform exclusively loosening work and loading work, whereas the transporting elements in the transporting run perform only the transporting work. The transporting elements in the working run does not perform any work, whereas the loosening elements in the transporting run in some cases can perform the transporting work. The invention thus deals only with the performance of a useful work. The requirements to the installing power are reduced, since the considerable power losses are dispensed with, in contrast to the conventional devices in which independent return guidance of the conveyor chain and the winning machine chain take place. The winning process and the transporting process are always continuing. Reverses do not take place. Because of this mechanical loading and dead time portion required for reversing are dispensed with. Since the transporting direction is opposite to the winning direction, the cross-section of the conveyor in the case of relatively small transporting and winning speeds can be used in an optimum manner.

In accordance with the present invention it is also possible to use for the first time known mining technique in the practice, which can be determined from the geological and operational conditions. For this purpose, in accordance with another feature of the present invention, the loosening elements located in the working run are brought in engagement with the working face over the length of the longwall within a short substantially S-shaped longitudinal region. Therefore the mining process takes place to a certain extent in a wave-like manner in the longitudinal direction of the longwall. Only where the shaft is located, the loosening elements engage with the working phase. The speed with which the wave moves through the longwall can here be determined upon the respective strength of the minerals and rock. Also the amplitude of the wave can be brought in correspondence with the various progress of the excavation.

In accordance with still a further feature of the present invention, the working face can be engaged by the loosening elements which are arranged in groups located one after the other. For example, always two groups can be in engagement. The loosening elements located in this group have a predetermined penetration depth with which they can be pulled over the entire length of the longwall through the working phase.

The main feature of the invention is to provide such a guidance for movement of the pulling means and such an integration of the loosening and transporting elements in the pulling means, that the constant useful work is performed. In connection with this, in the working run of the pulling means only loosening and loading work is performed. In the transporting run which runs in the opposite direction only transporting work is performed. Power losses which take place during return of the transporter chain in the lower run of a chain scraper conveyor and also in the return of the pulling chain for the recovery machines, are dispensed with. The drive aggregate of the inventive loosening and transporting arrangement can be located in a well-accessible manner in the accessory or parallel gallery. The reverse of the pulling means with the loosening and transporting elements at the longwall ends takes place, advantageously, by reversing wheels with axes of rotation inclined to the vertical plane. The angle of inclination is equal to substantially 45°.

For formation and arrangement of the loosening and transporting elements on the pulling means, it is advantageous when in accordance with a further feature of the present invention the pulling means is formed as a single chain strand which carries the transporting elements formed as carriers, and loosening elements formed as base bodies provided with loosening tools. Mounting of the pulling chain on the carriers and base bodies is performed substantially centrally.

Another feature of the present invention is that the base bodies and the carriers are formed identically. This simplifies the manufacture and holding of the base bodies and carriers.

Still another feature of the present invention is that the base body and the carrier are formed as a unilateral triangle with two catheus sides of equal length and an opposite longer hypotenuse side. When the base bodies and carriers are formed in accordance with this feature, a good guidance and a simple transit from the working run to the transporting run and vice versa is guaranteed, particularly when the chain wheels at the longwall ends are inclined, for example at the angle of 45°.

Yet another feature of the present invention is that the hypotenuse side is substantially 1.5 two times longer than the cathetus sides of the base bodies and carriers. In this case the carriers and base bodies reduce the total size of the loosening and transporting arrangement.

One cathetus side of the carriers and base bodies can be forcedly guided with their end portions in the working run, whereas the hypotenuse side of the same can be forceably guided with their end portion in the transporting run. This provides for simple forced (positive) guidance in the working and transporting run.

The carriers and the base bodies in the working run can be supported with one cathetus side on a ramp-like inclined surface, and in the transporting drum with both cathetus sides in an upwardly open V-shaped channel. The ramp surface reduced, in cooperation with the carriers and the base bodies or loosening elements, the loading work. The V-shaped cross-section of the transporting channel provides stable guidance with sufficient transporting capacity.

The transporting element and the loosening element can be guided slidingly and/or rollingly. In this case the carriers and the loosening elements are positively guided both in the working run and in the transporting run. The positive guidance, as mentioned above, can be performed in sliding manner or in rolling manner. In the latter case the energy-efficiency is improved and the power requirement is reduced.

The loosening element can be formed as cutting tools and wedging tools. In this case the minerals can be loosened and loaded by special tools. Thereby special considerations can be taken into account with respect to geological and operational conditions.

In the sense of method, it is advantageous to form the loosening elements of the chain strand so that they are arranged in groups. With such an arrangement it is especially advantageous to use such mining methods in which several loosening elements assembled in groups engage with the working face, and the winning of the minerals is performed by continuous displacement of this engaging longitudinal portion in the longitudinal direction of the longwall.

The loosening tools can be provided on the base body in different configurations, so that respective conditions can be individually taken into consideration.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
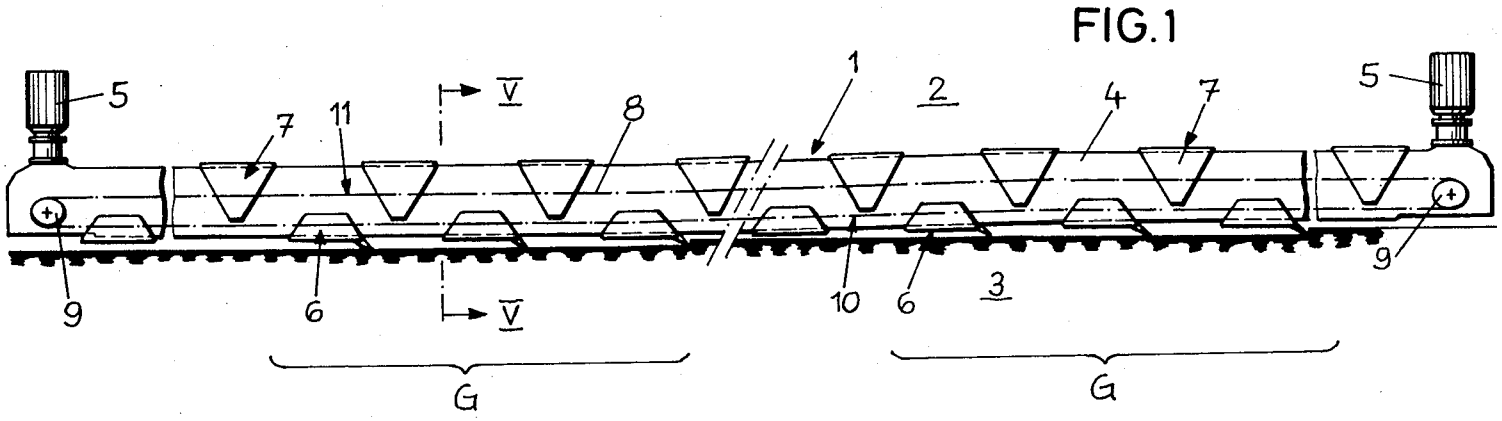
FIG. 1 is a plan view of a loosening and transporting arrangement with loosening elements located in engagement over the entire length of a longwall with a working phase.

FIG. 1 shows a loosening and transporting aggregate 1 which is subdivided into individual limitedly articulately connected with one another parts and located at a front longwall 2 along a working face 3. The loosening and transporting aggregate 1 can be arranged directly under the action of excavation frames as well as returning and guiding devices associated therewith. The loosening and transporting aggregate 1 includes, in principle, a guide frame 4, drives 5 at each side of it, loosening elements 6 and transporting elements 7. They are arranged on an annulus rotating chain strand 8. A working run 10 and a transporting run 11 are formed thereby between reversing wheels 9 and operate always in the same direction.

In the embodiment shown in FIG. 1 the loosening elements 6 are assembled in groups G. Transporting elements or carriers 7 are located between the groups of the loosening element G. Such a group is shown, for example, in FIG. 3. As can be seen from this Figure, the individual loosening elements 6 are integrated in a base body 12 and loosening tools 13. The loosening tools 13 can be associated with the base bodies 12 in different configurations.

The loosening tools 13 inside each group G can operate in cutting or wedging manner and in some cases can perform loading work. In the embodiment shown in FIG. 1, two groups G of the loosening elements 6 are located at a distance from one another in engagement with the working face 3. The loosening tools 13 of each group G engage on the working face 3 differently. This method deals with substantially a disc cut, with which the guide frame 4 is displaced over the entire length of the longwall continuously and rectilinearly along the working face 3. The loosening tools 13 are in engagement with the working face 3 over approximately the entire length of the longwall.

Figure 2:
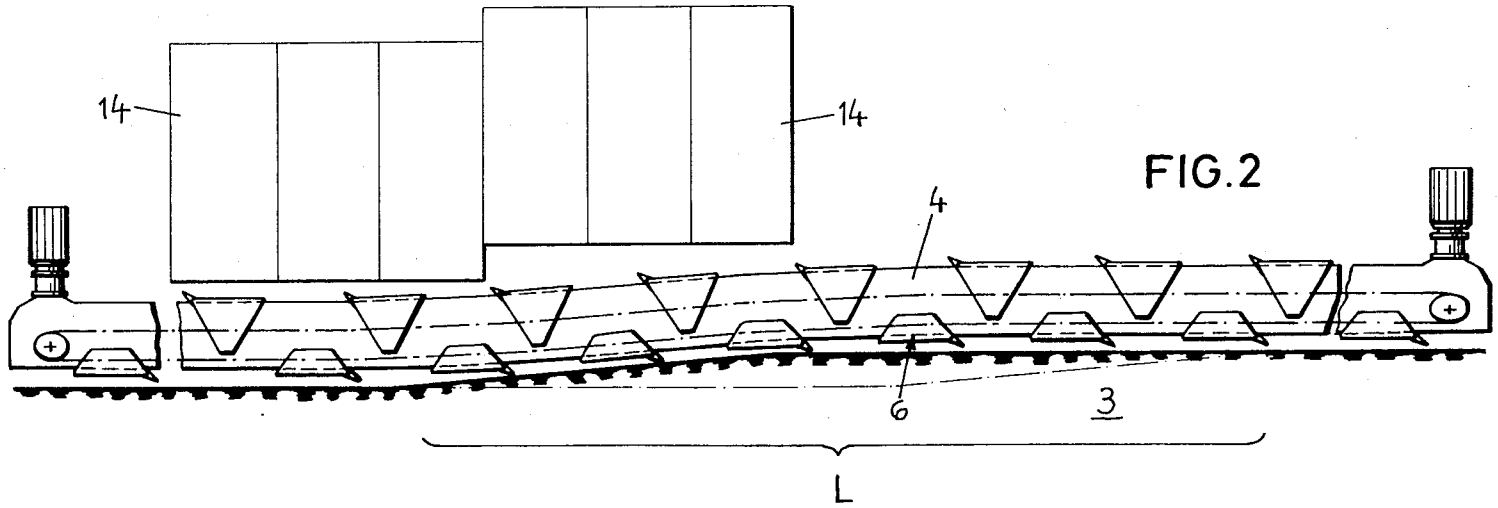
FIG. 2 is a view showing the loosening and transporting arrangement of FIG. 1 which the loosening elements which are in engagement with the working phase over only partial region of the length of the longwalls.

FIG. 2 shows a mining method in accordance with which the loosening elements 6 are in engagement with the working face 3 only over a limited longitudinal region L. Here the guide frame 4 is of the shape of a wave which is curved in S-shaped manner. In the region of the wave which is displaced from one end of the longwall to the other end of the same, the loosening elements 6 are in engagement with the working face 3. The speed with which this wave shaped portion of frame 4 is forwarded in the longitudinal direction of the longwall can be determined in dependence upon the surrounding condition and the wave amplitude on the advancement value of an associated longwall support 14. In FIG. 2 two longwall frames 4 are shown.

Figure 5:
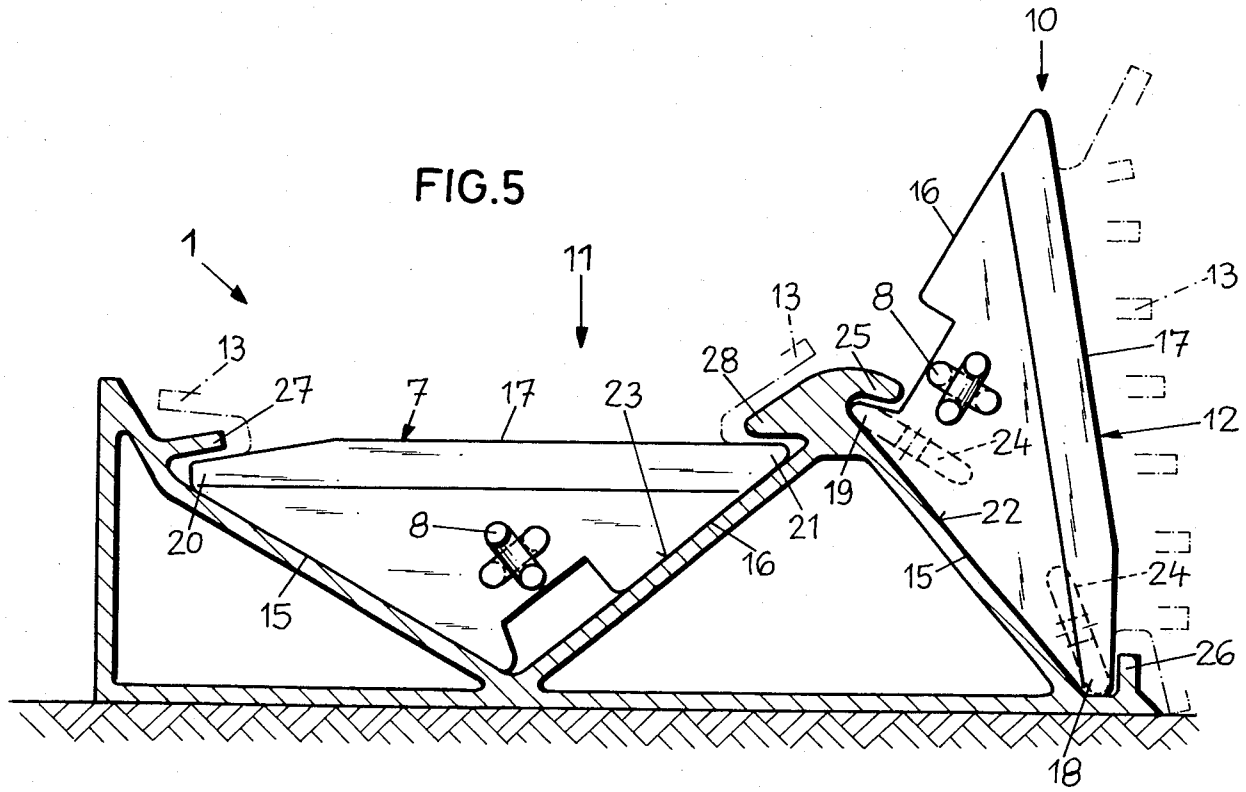
FIG. 5 is a view showing a vertical section of the loosening and transporting arrangement of FIG. 1, taken along the line V—V, on an enlarged scale.

FIG. 5 shows a cross-section of a loosening and transporting aggregate 1. First, it can be seen that both the carrier 7 and the base body 12 for the loosening tools 13 have identical cross-sections. This cross-section is substantially equal to a unilateral triangle with two substantially equal elongated cathetus sides 15 and 16 and an opposite longer hypotenuse side 17. The hypotenuse side 17 is substantially 1.5–2 times longer than the cathetus sides 15 or 16. In the working run 10 the cathetus side 15 is forceably guided with its end portions 18 and 19, and in the transporting run 11 the hypotenuse side 17 is forceably guided with its end portions 20 and 21. For this purpose the carrier 7 and the base body 12 are supported with the cathetus side 15 in the working run 10 on a ramp-like inclined surface 22 and in the transporting run 11 with both cathetus sides 15 and 16 in an upwardly opened V-shaped channel 23. The loosening tools 13 are shown only schematically in FIG. 5.

Figure 4:
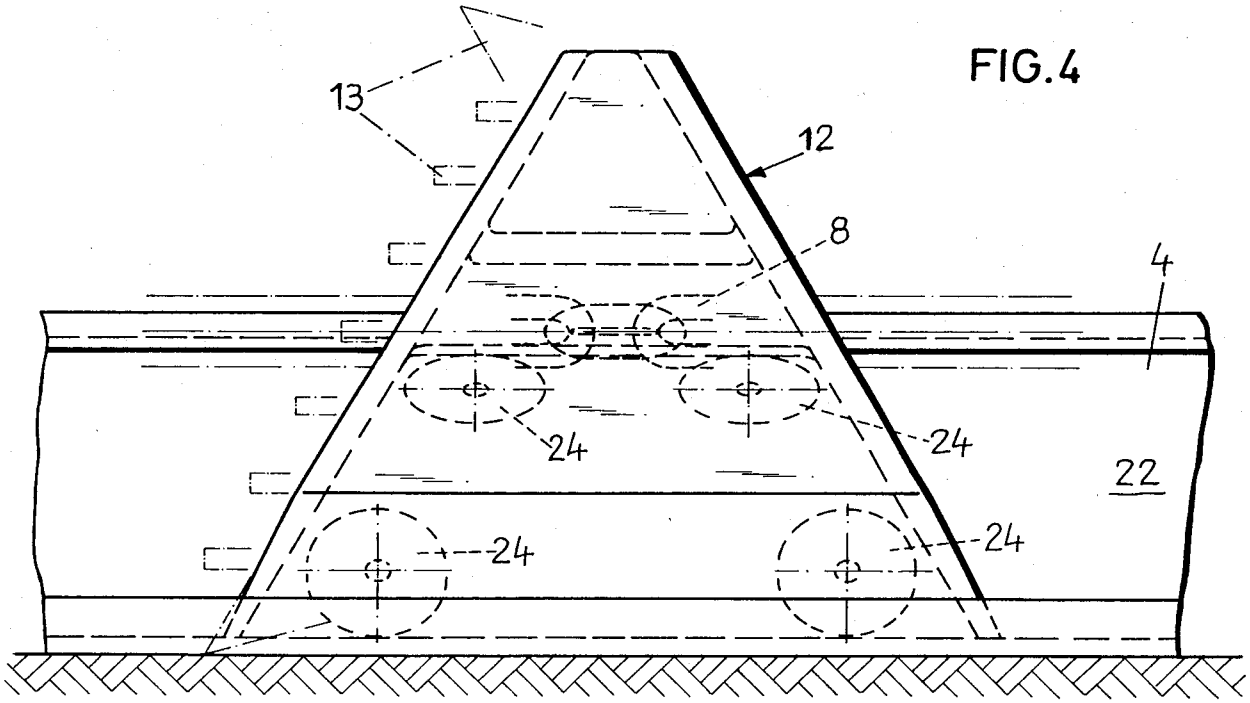
Fig. 4 is a view showing an individual loosening element, also as seen from the working phase, on an enlarged scale.

From consideration of FIGS. 4 and 5 it can be seen that the carrier 7 and the base bodies 12 can be forceably or positively guided in a sliding manner or in a rolling manner. The guidance with rollers 24 is limited in this case substantially to the working run 10. The ramp 22 is limited from above and from below by flanges 25 and 26, and the channel 23 is limited at the left side and at the right side by flanges 27 and 28.

Figure 6:
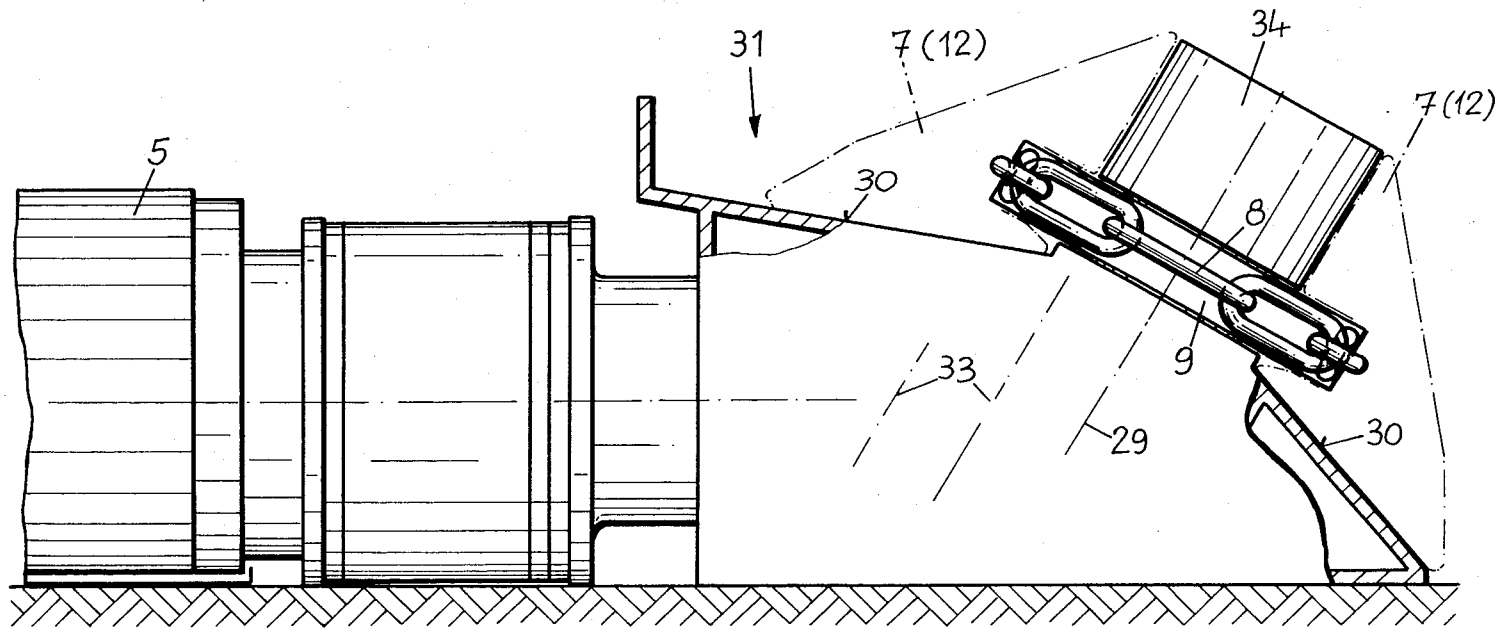
FIG. 6 is an end view of the loosening and transporting arrangement of FIG. 1, partially in section.
Figure 7:
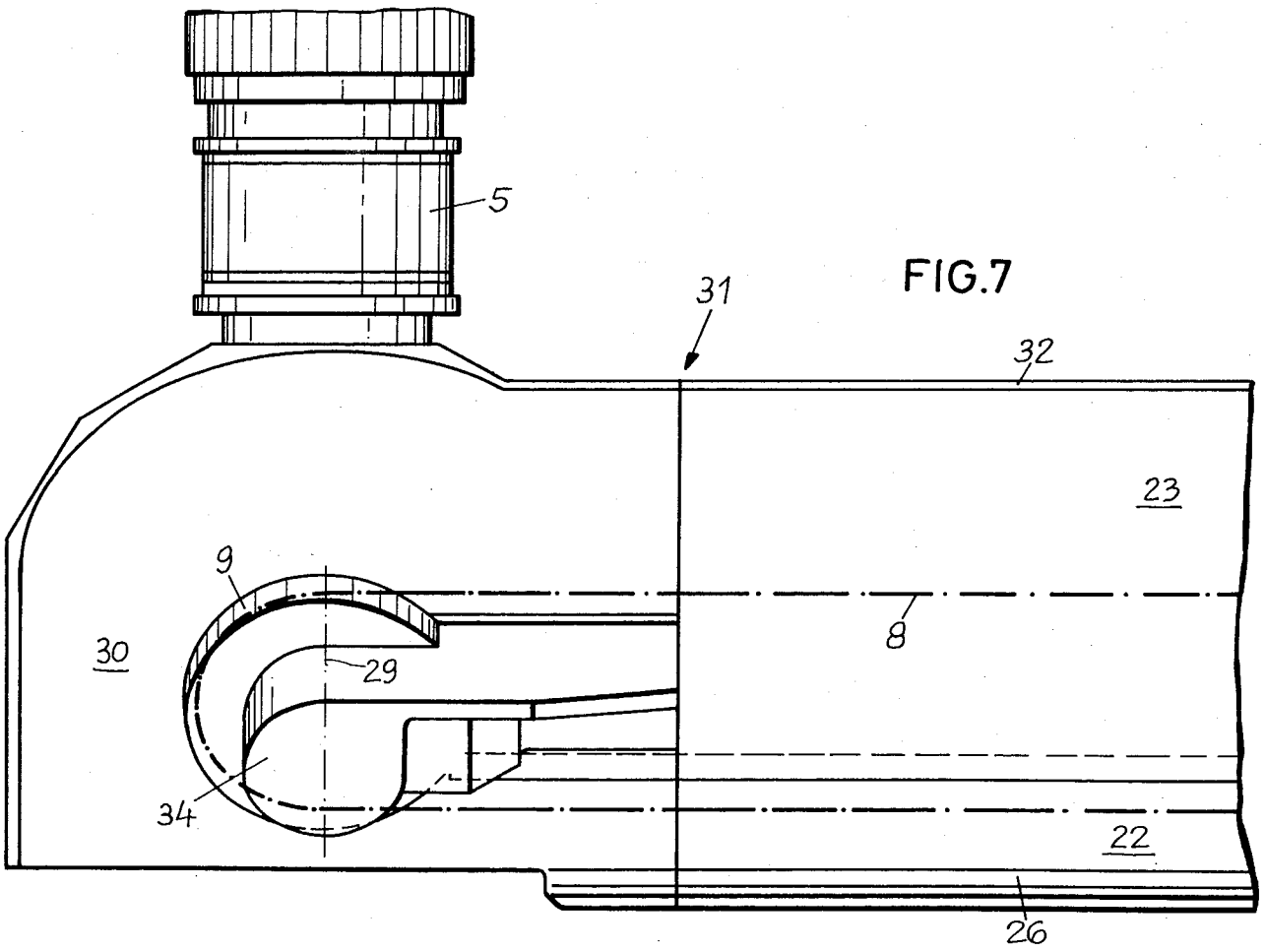
FIG. 7 is a plan view of the end portion of the loosening and transporting arrangement of FIG. 7.
Figure 8:
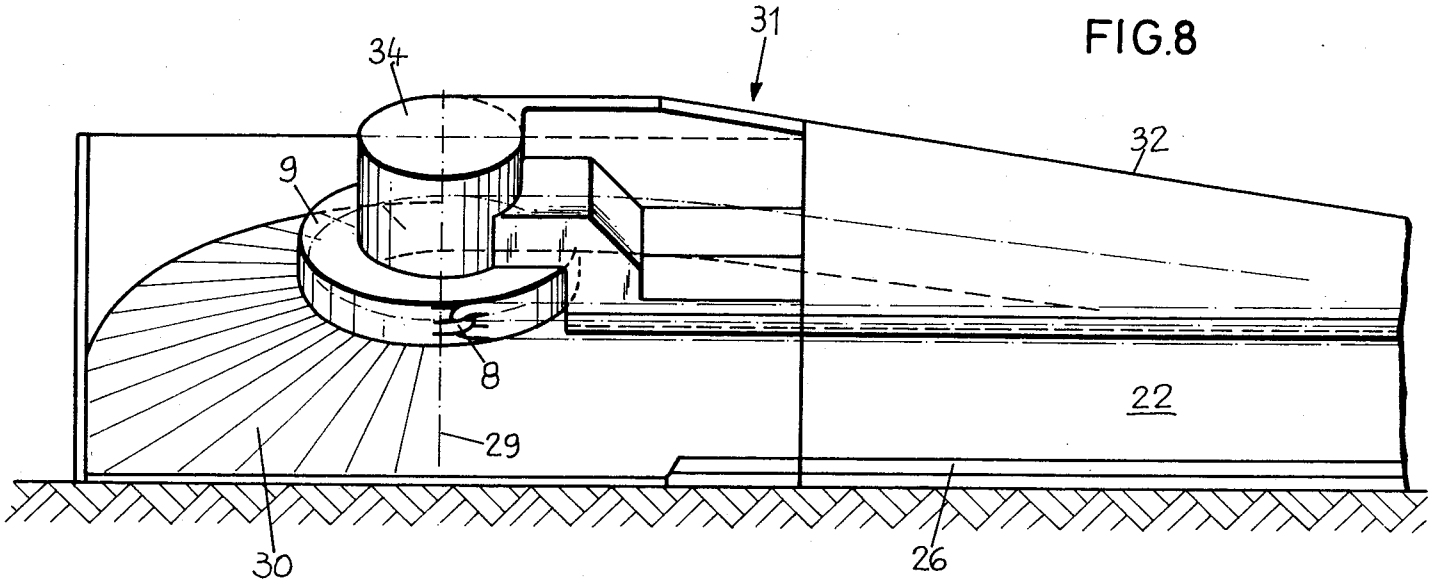
FIG. 8 is a view of the end portion of the loosening and transporting arrangement of FIG. 7 as seen from the working phase.

The deflection of the chain strand 8 from the working run 10 to the transporting run 11 and vice versa, as well as the transition of the carrier 7 and the base body 12 from one run to the other is shown in FIGS. 6–8. As can be seen from these Figures, axes 29 of the deflecting wheels 9 are inclined for this purpose. The inclination angle amount in the shown embodiment to 60° relative to the horizontal plane. Because of this inclination and correspondingly formed inclined surface 30 at the periphery of the chain wheels 9, the carrier 7 and the base body 12 can transit in a simple manner from the working run 10 to the transporting run 11. It is, however, required that the height difference needed for the inclination in the region of the deflection stations 31 be compensated by a transition slip 32. The drive 5 can be arranged on a floor in lying condition. The required transmission stages 33 are shown in FIG. 6 by dash-dot lines. For better deviation of the carrier 7 and the base body 12, the chain wheels 9 are provided with cylindrical projections 34. The cathetus sides 16 abut against the projections 34.

Carriers 7, on the one hand, and the base bodies 12 for loosening tools 13 on the other hand, are handled on a single unit. As seen from the face of the coal being cut, carriers 7 and bodies (FIGS. 3 and 4) have each a triangle shape. FIG. 5 illustrates carriers 7 and base bodies 12 which also have a triangle shape as seen in the direction of elongation.

Figure 3:
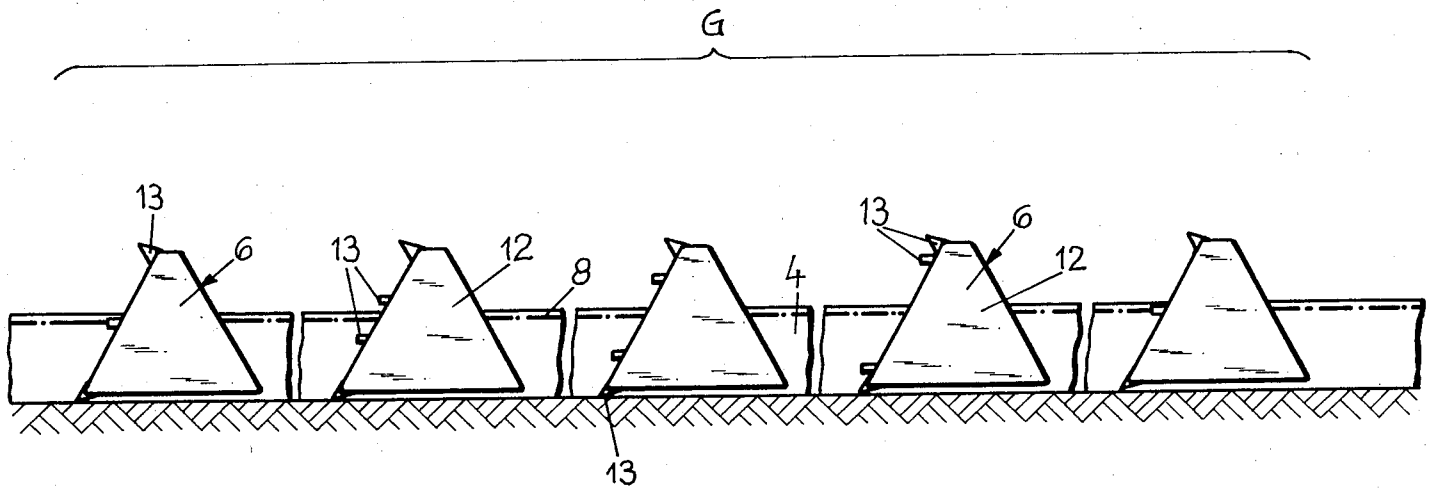
FIG. 3 is a view showing a group of the loosening elements as seen from the working phase, on an enlarged scale.

If the base bodies for 12 for loosening tools 13 are in use loosening tools 13 in form of, for example loosening chisels, would be arranged along the inclined edges of base bodies 12 facing the face of working as seen from the wall 2. These loosening chisels are releasably inserted in the pockets along those inclined edges. The loosening chisels project in the direction of running of the base bodies 12 as seen in FIGS. 3 and 4 and against the working face as shown in FIG. 5. Thereby the loosening tools or chisels 13 would engage in the face of working of the mineral and loosen or cut the same.

Carriers 7 as well as base bodies 12 with their surfaces 15 in the working run 10 would slide on the inclined surface 22 of the loosening and transporting aggregate 1.

The loosened or cut material would be then forced in front of the base bodies 12 and due to a movement of the base bodies 12 relative to the loosening and transporting aggregate 1, would be moved in the running direction by the front surfaces of the base bodies 12 which are limited by edges 15, 16 and 17 over the inclined surfaces 22 into the transporting run 11.

At the end of the loosening and transporting aggregate 1, the carriers 7 and base bodies 12 are guided or moved with their surfaces, limited by inclined edges 15 and lying on the inclined surfaces 22, over the inclined surfaces 30 (FIGS. 6 to 8) from the working run 10 into the transporting run 11, and at the other end, from the transporting run into the working run.

In the transporting run 11, the cuttings of the mineral are taken by the base bodies 12 and the carriers 7 and also by those base bodies 12 which are limited by edges 15, 16 and 17.

It will be understood that each of the elements described above, or two or more together, may also find a useful application in other types of constructions differing from the types described above.

While the invention has been illustrated and described as embodied in an arrangement for loosening, loading and transporting stratified minerals, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the present invention.

What is claimed as new and desired to be protected by Letters Patent is set forth in the appended claims:

1. A method of loosening, loading and transporting stratified minerals, especially coal in underground longwalls, comprising the steps of providing single endless rotatable and positively guided pulling means with integrated loosening elements and transporting elements and having a working run and a transporting run; loosening and loading minerals by the loosening elements of the single pulling means so that the minerals are only loosened and loaded in the working run of the single pulling means; and transporting the minerals by the transporting elements of the single pulling means so that the minerals are transported by the transporting run moving in an opposite direction relative to the working run.

2. A method as defined in claim 1, wherein said loosening step includes bringing the loosening elements of the working run in engagement with a working face only within a short substantially S-shaped longitudinal region extending over a longwall length.

3. A method as defined in claim 1, wherein said loosening step includes bringing the loosening elements arranged in groups located one after the other to engagement with the working face.

4. An arrangement for loosening, loading and transporting stratified minerals, especially coal in underground longwalls, comprising endless rotary pulling means rotating in a longitudinal direction of a longwall and having a working run extending in the longitudinal direction of the longwall and a transporting run located behind the working run at a back filling side; loosening elements integrated in said pulling means on said working run to loosen as well as to load the minerals; and transporting elements integrated in said pulling means and arranged on said transporting run for transporting the minerals in the opposite longitudinal direction of the longwall.

5. An arrangement as defined in claim 4, wherein said loosening elements in said transporting run are arranged for transporting the minerals together with the transporting elements.

6. An arrangement as defined in claim 4, wherein said pulling means includes a single chain strand, said transporting elements being formed as carriers releasably mounted on said chain strand, and said loosening elements including base bodies which carry loosening tools and are releasably mounted on said chain strand.

7. An arrangement as defined in claim 6, wherein said base bodies are formed identically to said carriers.

8. An arrangement as defined in claim 7, wherein each of said base bodies and said carriers has a cross-section of a unilateral triangle with two substantially equally long cathetus sides and an opposite longer hypotenuse side.

9. An arrangement as defined in claim 8, wherein each of said cathetus sides has a predetermined length, said hypotenuse side having a length which is equal to substantially 1.5–2 times the length of each of the cathetus sides.

10. An arrangement as defined in claim 8, wherein one cathetus side has end portions which are forceably guided in said working run, said hypotenuse side having end portions which are forceably guided in said transporting run.

11. An arrangement as defined in claim 8, wherein said pulling means has a ramp-like inclined surface which supports said carrier and said base body in said working run with one cathetus side, and an upwardly open V-shaped channel which supports said carrier in said base body with both cathetus sides in said transporting run.

12. An arrangement as defined in claim 4, wherein said transporting elements and said loosening elements are forceably guided in a sliding manner.

13. An arrangement as defined in claim 4, wherein said transporting elements and said loosening elements are forceably guided in a rolling manner.

14. An arrangement as defined in claim 4, wherein said transporting element and said loosening elements are guided in sliding and rolling manner.

15. An arrangement as defined in claim 4, wherein said loosening elements are integrated in a cutting tool and a wedging tool.

16. An arrangement as defined in claim 4, wherein said loosening elements are assembled in groups.

17. An arrangement as defined in claim 4, wherein said loosening elements include a base body and loosening tools arranged on said base body and having different configurations.

* * * * *